US008960210B2

(12) United States Patent
Bacik

(10) Patent No.: US 8,960,210 B2
(45) Date of Patent: Feb. 24, 2015

(54) FLEXIBLE UMBRELLA SYSTEMS

(76) Inventor: John Andrew Bacik, Scottsdale, AZ (US)

( * ) Notice: Subject to any disclaimer, the term of this patent is extended or adjusted under 35 U.S.C. 154(b) by 1102 days.

(21) Appl. No.: 12/354,323

(22) Filed: Jan. 15, 2009

(65) Prior Publication Data

US 2009/0188537 A1 Jul. 30, 2009

Related U.S. Application Data

(60) Provisional application No. 61/024,855, filed on Jan. 30, 2008, provisional application No. 61/043,105, filed on Apr. 7, 2008, provisional application No. 61/061,612, filed on Jun. 14, 2008.

(51) Int. Cl.

| | |
|---|---|
| ***A45B 17/00*** | (2006.01) |
| ***A45B 25/22*** | (2006.01) |
| *A45B 23/00* | (2006.01) |

(52) U.S. Cl.

CPC ..... *A45B 17/00* (2013.01); *A45B 25/22* (2013.01); *A45B 2017/005* (2013.01); *A45B 2023/0012* (2013.01)

USPC ..... 135/20.1; 135/16; 135/98; 403/220

(58) Field of Classification Search

USPC ..... 135/98, 16, 20.1, 25.4, 114, 155; 267/166–169; 248/160, 317, 514; 403/220, 229, 291; 108/50.12

See application file for complete search history.

(56) References Cited

U.S. PATENT DOCUMENTS

| | | | | |
|---|---|---|---|---|
| 588,958 | A * | 8/1897 | Crandall | 135/20.1 |
| 1,790,500 | A * | 1/1931 | Fischer | 248/160 |
| 2,554,708 | A * | 5/1951 | Kosten | 440/102 |
| 3,930,514 | A | 1/1976 | Wu | |
| 4,332,399 | A * | 6/1982 | Kepple | 280/819 |
| 4,567,907 | A * | 2/1986 | Dubinsky | 135/20.3 |
| 4,636,109 | A * | 1/1987 | Clausen et al. | 404/10 |
| 5,368,055 | A | 11/1994 | Johnson et al. | |
| 5,433,233 | A | 7/1995 | Shiran et al. | |
| 5,871,024 | A | 2/1999 | Vanderminden, Sr. | |
| 5,896,880 | A * | 4/1999 | Bushweller et al. | 135/16 |
| 6,328,047 | B1 * | 12/2001 | Lee | 135/20.1 |
| 6,330,886 | B1 | 12/2001 | Culver | |
| 6,371,465 | B1 * | 4/2002 | Willis et al. | 267/169 |
| 6,471,289 | B2 * | 10/2002 | Aguilar | 297/184.16 |
| 6,497,242 | B1 | 12/2002 | Lin et al. | |
| 6,561,178 | B1 | 5/2003 | Hayes | |
| 6,736,151 | B2 | 5/2004 | Lin et al. | |
| 6,810,890 | B2 * | 11/2004 | Lin et al. | 135/16 |
| 6,899,388 | B1 * | 5/2005 | Enrique | 297/184.16 |
| 7,207,343 | B2 | 4/2007 | Earnshaw et al. | |
| 7,537,016 | B1 * | 5/2009 | You | 135/16 |
| 2004/0035452 | A1 | 2/2004 | Ma | |

FOREIGN PATENT DOCUMENTS

| | | | | |
|---|---|---|---|---|
| AU | WO9503724 | A1 | 2/1995 | |
| EP | 368539 | A2 | 5/1990 | |
| FR | 2846525 | A1 * | 5/2004 | A45B 17/00 |
| NZ | WO2005048765 | A1 | 6/2005 | |

* cited by examiner

*Primary Examiner* — Winnie Yip

(74) *Attorney, Agent, or Firm* — Whitley Legal Group, PC; AnnMarie W. Whitley

(57) ABSTRACT

An umbrella system relating to the general protection of fixed outdoor umbrellas, especially during windy conditions. The umbrella system uses a supportive shaft equipped with a resiliently deformable region allowing omni-directional bending under wind loading. A preferred embodiment of the deformable region comprises a helical spring.

20 Claims, 9 Drawing Sheets

FLEXIBLE UMBRELLA SYSTEMS

CROSS-REFERENCE TO RELATED APPLICATION

The present application is related to and claims priority from prior provisional application Ser. No. 61/024,855, filed Jan. 30, 2008, entitled "FLEXIBLE UMBRELLA SYSTEMS"; and, this application is related to and claims priority from prior provisional application Ser. No. 61/043,105, filed Apr. 7, 2008, entitled "FLEXIBLE UMBRELLA SYSTEMS"; and, this application is related to and claims priority from prior provisional application Ser. No. 61/061,612, filed Jun. 14, 2008, entitled "FLEXIBLE UMBRELLA SYSTEMS", the contents of all of which are incorporated herein by this reference and are not admitted to be prior art with respect to the present invention by the mention in this cross-reference section.

BACKGROUND

This invention relates to providing a system for improved umbrellas. More particularly, this invention relates to providing a system for the general protection of fixed outdoor umbrellas, especially during windy conditions.

Conventional outdoor patio umbrellas, for protection from rain or sun, typically comprise a cover portion supported by a rigid shaft. Such conventional outdoor patio umbrellas are often used to shade patio tables or other outdoor furniture. Large outdoor patio-type umbrellas are generally designed to withstand small to moderate wind loading. It is common for the supportive shafts of such umbrellas to fracture or even snap in half under heavy wind loads, especially if made out of a material prone to fracture, such as many woods, etc. Moreover, the supportive members within the fabric canopy are susceptible to impact damage should the umbrella tip, as may occur following a strong wind gust.

Many umbrella manufacturers recommend removing and storing such umbrellas if windy conditions are anticipated. Removing and storing such umbrellas is especially inconvenient to users who must make special efforts to protect the umbrellas prior to inclement weather. An invention to enable the canopy and support shaft of such umbrellas to better withstand structural forces due to wind loading, would be of benefit to many.

OBJECTS AND FEATURES OF THE INVENTION

A primary object and feature of the present invention is to provide a system overcoming the above-mentioned problems.

It is a further primary object and feature of the present invention to provide such a system to protect an umbrella center-shaft during windy conditions.

It is another object and feature of the present invention to provide such a system to protect the supportive members of an umbrella fabric canopy should the umbrella overturn in windy conditions.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides an umbrella system related to reducing wind damage in outdoor umbrellas subjected to at least one wind load during use, such system comprising: at least one umbrella structured and arranged to provide umbrella-type shade protection; wherein such at least one umbrella comprises at least one umbrella shade structured and arranged to provide such umbrella-type shade protection, and coupled with such at least one umbrella shade, at least one shaft support structured and arranged to support such at least one umbrella shade in at least one operable position; wherein such at least one shaft support comprises at least one omni-directional flexor structured and arranged to provide omni-directional flexing of such at least one shaft support when such at least one umbrella shade is subjected to the at least one wind load; wherein such omni-directional flexing assists in reducing deflection-related failure within such at least one shaft support when such at least one shaft support is subjected to force loading.

Moreover, it provides such an umbrella system wherein such at least one shaft support further comprises: at least one first substantially rigid shaft portion comprising at least one first longitudinal axis; at least one second substantially rigid shaft portion comprising at least one second longitudinal axis; and at least one shaft-end coupler structured and arranged to structurally couple such at least one first substantially rigid shaft portion to such at least one umbrella shade portion; wherein such at least one shaft-end coupler is structured and arranged to transmit at least one non-axial force between such at least one first substantially rigid shaft portion and such at least one umbrella shade portion; wherein such at least one omni-directional flexor comprises at least one resilient member structured and arranged to provide resilient bending in response to non-axial force loading, at least one first shaft coupler structured and arranged to couple such at least one resilient member to such at least one first substantially rigid shaft portion, and at least one second shaft coupler structured and arranged to couple such at least one resilient member to such at least one second substantially rigid shaft portion.

Additionally, it provides such an umbrella system wherein such at least one omni-directional flexor further comprises at least one biaser structured and arranged to bias such first longitudinal axis and such at least one second longitudinal axis to at least one substantially coaxial orientation. Also, it provides such an umbrella system wherein such at least one biaser provides for movement of such first longitudinal axis and such at least one second longitudinal axis away from such at least one substantially coaxial orientation when a predetermined level of force is applied to such at least one first substantially rigid shaft portion.

In addition, it provides such an umbrella system wherein such at least one resilient member comprises at least one coiled spring. And, it provides such an umbrella system wherein such at least one coiled spring is capable of storing at least one spring return force of sufficient magnitude to return such at least one first shaft portion and such at least one second shaft portion to such at least one substantially coaxial orientation when such force applied to such at least one first shaft portion is substantially absent.

Further, it provides such an umbrella system wherein such resilient bending occurs substantially within such at least one coiled spring. Even further, it provides such an umbrella system further comprising: at least one outer cover structured and arranged to cover such at least one coiled spring; wherein such at least one outer cover comprises at least one substantially resilient composition structured and arranged to resiliently deform in coordination with such resilient bending. Moreover, it provides such an umbrella system wherein such at least one first substantially rigid shaft portion and such at least one second substantially rigid shaft portion each comprise a substantially cylindrical rod. Additionally, it provides such an umbrella system wherein: such at least one first shaft coupler comprises at least one first threaded coupler structured and arranged to threadably couple such at least one first shaft coupler to such at least one first substantially rigid shaft portion; and such at least one second shaft coupler comprises at least one second threaded coupler structured and arranged to threadably couple such at least one second shaft coupler to such at least one second substantially rigid shaft portion.

Additionally, it provides such an umbrella system wherein: such at least one omni-directional flexor is located above about the upper third of such at least one shaft support. Also, it provides such an umbrella system wherein: such at least one first substantially rigid shaft portion and such at least one second substantially rigid shaft portion each comprise at least one hollow cylindrical tube having at least one substantially hollow interior portion; such at least one second substantially rigid shaft portion comprises at least one remote operator structured and arranged to remotely operate opening and closing of such at least one umbrella shade; wherein such at least one remote operator comprises at least one cord structured and arranged to operably connect such at least one remote operator with said at least one umbrella shade; wherein such at least one cord passes through such substantially hollow interior portions of such at least one first substantially rigid shaft portion and such at least one second substantially rigid shaft portion; wherein such at least one omni-directional flexor comprises at least one continuous internal passage structured and arrange to allow unencumbered passage of such at least one cord between such substantially hollow interior portions of such at least one first substantially rigid shaft portion and such at least one second substantially rigid shaft portion. In addition, it provides such an umbrella system wherein such at least one first shaft coupler and such at least one second shaft coupler each comprise at least one projecting engager structured and arranged to engage at least one interior bore of such at least one coiled spring.

In accordance with another preferred embodiment hereof, this invention provides an umbrella system related to reducing wind damage in outdoor umbrellas subjected to at least one wind load during use, such system comprising: at least one umbrella structured and arranged to provide umbrella-type shade protection; wherein such at least one umbrella comprises at least one umbrella shade structured and arranged to provide such umbrella-type shade protection, and coupled with such at least one umbrella shade, at least one shaft support structured and arranged to support such at least one umbrella shade in at least one operable position; wherein such at least one shaft support comprises at least one first shaft portion comprising at least one first longitudinal axis, at least one second shaft portion comprising at least one second longitudinal axis, and positioned between such at least one first shaft and such at least one second shaft, at least one coil spring; wherein such at least one coil spring is structured and arranged to bend in response to the application of at least one predetermined amount of force to such at least one shaft support, and maintain such first longitudinal axis and such at least one second longitudinal axis in at least one substantially coaxial orientation when such force is less than such predetermined amount; wherein such bending assists in reducing structural failure within such at least one shaft support when at least one force greater than such at least one predetermined amount of force is applied to such at least one shaft support.

Also, it provides such an umbrella system wherein such bending occurs substantially within such at least one coil spring. In addition, it provides such an umbrella system further comprising: at least one outer cover structured and arranged to cover such at least one coiled spring; wherein such at least one outer cover comprises at least one substantially resilient composition structured and arranged to resiliently deform in coordination with such bending. And, it provides such an umbrella system wherein such at least one first shaft portion and such at least one second shaft portion each comprises a substantially cylindrical rod. Further, it provides such an umbrella system wherein such at least one first shaft portion, such at least one second shaft portion, and such at least one outer cover each comprise a substantially similar outer diameter. Even further, it provides such an umbrella system wherein such at least one coiled spring is capable of storing at least one spring return force of sufficient magnitude to return such at least one first shaft portion and such at least one second shaft portion to such at least one substantially coaxial orientation when such force applied to such at least one first shaft portion is substantially absent.

In accordance with another preferred embodiment hereof, this invention provides an umbrella system related to reducing wind damage in outdoor umbrellas subjected to at least one wind load during use, such system comprising: umbrella means for providing umbrella-type shade protection; wherein such umbrella means comprises umbrella shade means for providing such umbrella-type shade protection, and coupled with such umbrella shade means, shaft support means for supporting such umbrella shade means in at least one operable position; wherein such shaft support means comprises omni-directional flexor means for providing omni-directional flexing of such shaft support means when such umbrella shade means is subjected to the at least one wind load; wherein such omni-directional flexing assists in reducing deflection-related failure within such shaft support means when such shaft support means is subjected to force loading.

Even further, it provides such an umbrella system wherein such omni-directional flexor means comprises spring-force means for providing at least one spring force. Even further, it provides such an umbrella system wherein such spring-force means is structured and arranged to store at least one restorative force of sufficient magnitude to return such shaft support means to such at least one substantially un-flexed configuration when such force loading is substantially absent.

DETAILED DESCRIPTION OF THE BEST MODES AND PREFERRED EMBODIMENTS OF THE INVENTION

Figures 1A, 1B:
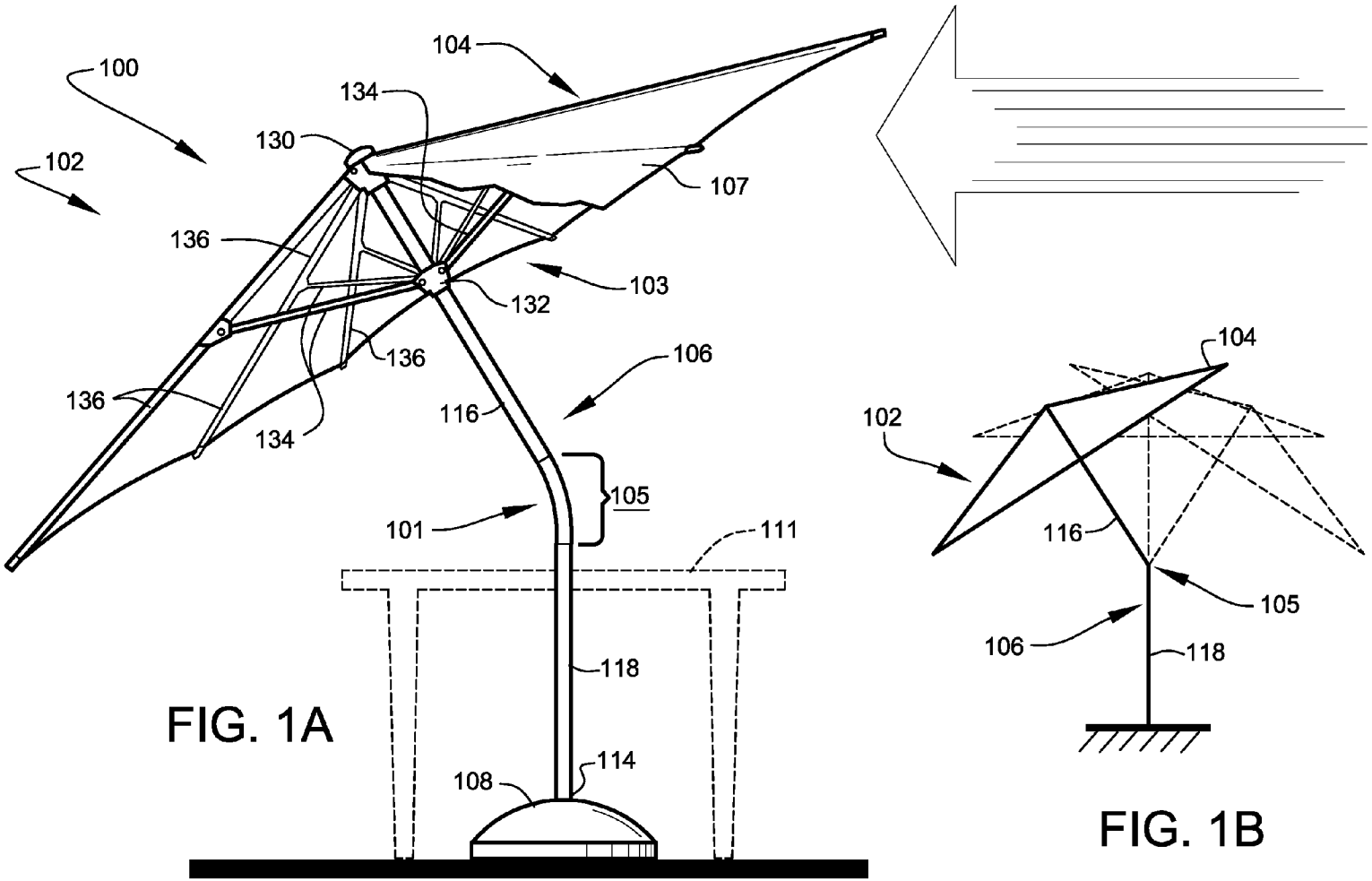
FIG. 1A shows a side view, in partial section, illustrating a flexible-shaft umbrella, according to a preferred embodiment of the present invention.
FIG. 1B shows a schematic diagram illustrating, omni-directional flexing by the flexible-shaft umbrella according to the preferred embodiment of the present invention.

FIG. 1A shows a perspective view, illustrating an improved flexible-shaft umbrella 102 according to a preferred embodiment of flexible umbrella system 100. Preferably, flexible-shaft umbrella 102 comprises at least one patio-type umbrella canopy 104 designed to provide umbrella-type shade protection for one or more users. Umbrella canopy 104 preferably comprises a flexible shade material 107 held on a collapsible frame of supportive ribs radiating from the top of shaft support 106, as shown. Preferably, umbrella canopy 104 is structurally coupled to shaft support 106, which preferably supports umbrella canopy 104 in the illustrated operable position.

Preferably, flexible umbrella 102 can be used as a free-standing element, or alternately preferably, engaged within furniture element 111 (such as an outdoor table as schematically illustrated by the dashed-line depiction). When needed, base 114 of flexible umbrella 102 is preferably connected to weighted umbrella stand 108. In either preferred arrangement, at least one portion of shaft support 106 is restrained against movement, as shown. Preferably, shaft support 106 comprises at least one region of reduced structural rigidity 105 intended to resiliently "yield" under force loading, as further described below.

Preferably, such region of reduced structural rigidity 105 within shaft support 106 comprises at least one omni-directional flexor 101 structured and arranged to provide omni-directional flexing of shaft support 106 when umbrella canopy 104 is subjected wind loading. More specifically, omni-directional flexor 101 allows shaft support 106 to bend (deflect), in a structurally significant manner, preferably without permanent damage to shaft support 106. Omni-directional flexor 101 is preferably designed to allow such bending to occur in substantially any direction, as diagrammatically illustrated in FIG. 1B. Thus, such preferred "omni-directional" flexing assists in reducing deflection-related failure within such at least one shaft support when such at least one shaft support is subjected to force loading. In addition, the above-described preferred configuration of shaft support 106 assists in protecting the rigid support elements of umbrella canopy 104 from impact damage, should the system be overturned after a wind gust, as further described in FIG. 4.

Preferably, first shaft portion 116 is coupled to umbrella canopy 104 by shaft-end coupler assembly 103, as shown. Preferably, shaft-end coupler assembly 103 comprises, in combination, upper hub 130, lower runner 132, and a plurality of radially-disposed stretchers 134 supporting a plurality of radially-disposed ribs 136, as shown. Preferably, the lower ends of the plurality of radially-disposed stretchers 134 are coupled to lower runner 132, as shown. Preferably, lower runner 132 is slideably engaged on first shaft portion 116 such that umbrella canopy 104 may be raised and lowered in a customary manner. Preferably, shaft-end coupler assembly 103 is structured and arranged to structurally couple first shaft portion 116 to umbrella canopy 104 to enable the transmission of both axial and non-axial force loads therebetween. Thus, forces generated at umbrella canopy 104 by wind loading are preferably transmitted to shaft support 106.

Figure 1D:
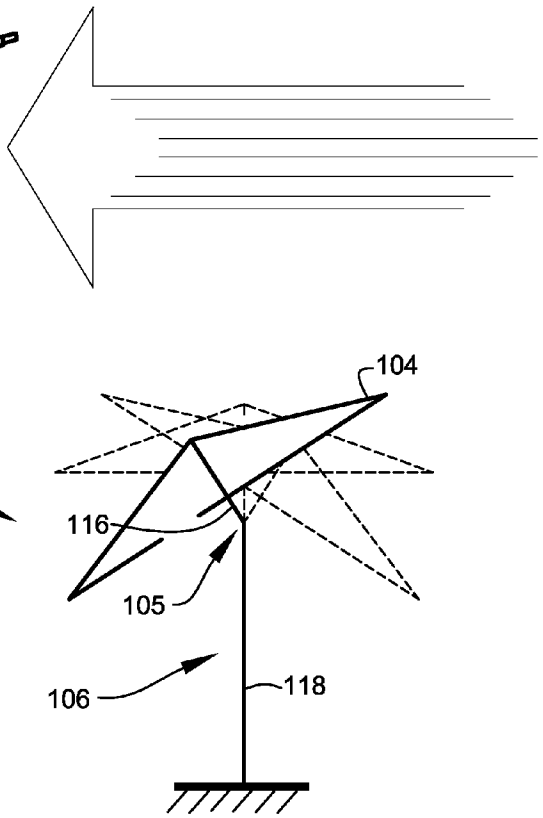
FIG. 1D shows a schematic diagram illustrating, the alternate omni-directional flexing by preferred flexible-shaft umbrella of FIG. 1C.
Figure 1C:
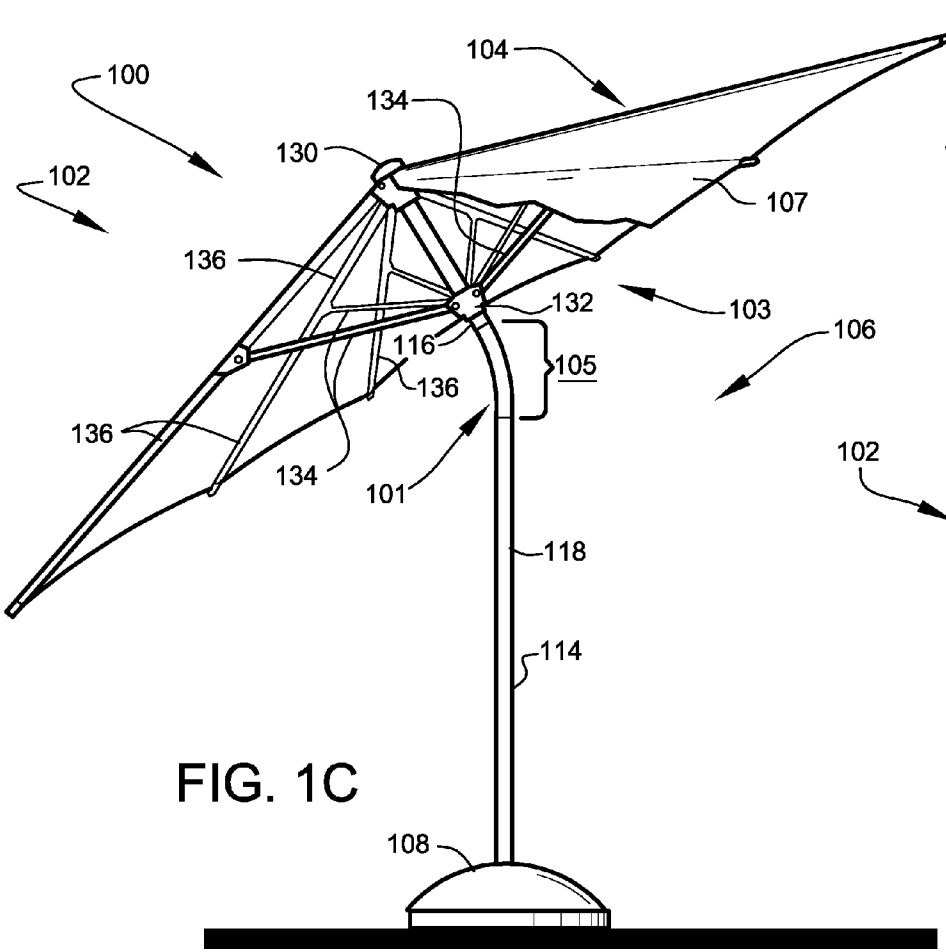
FIG. 1C shows a side view, in partial section, illustrating an alternate preferred location of omni-directional flexing within a preferred flexible-shaft umbrella, according to a preferred embodiment of the present invention.

FIG. 1C shows a side view, in partial section, illustrating a highly-preferred alternate location of omni-directional flexor 101 within the upper third of shaft support 106, according to another preferred embodiment of flexible umbrella system 100. FIG. 1D shows a schematic diagram illustrating, the similar range of motion afforded by upwardly-positioned omni-directional flexor 101. In the alternate preferred positioning depicted in FIG. 1C and FIG. 1D, omni-directional flexor 101 has been located in a position higher within with in shaft support 106, as shown. More specifically, omni-directional flexor 101 is preferably located above the upper third of shaft support 106, closely adjacent to lower runner 132 (when umbrella canopy 104 is in the open position depicted in FIG. 1C). Omni-directional flexor 101 is preferably configured to not impede translational movement of lower runner 132 up along shaft support 106 during opening and closing of umbrella canopy 104.

Figure 2:
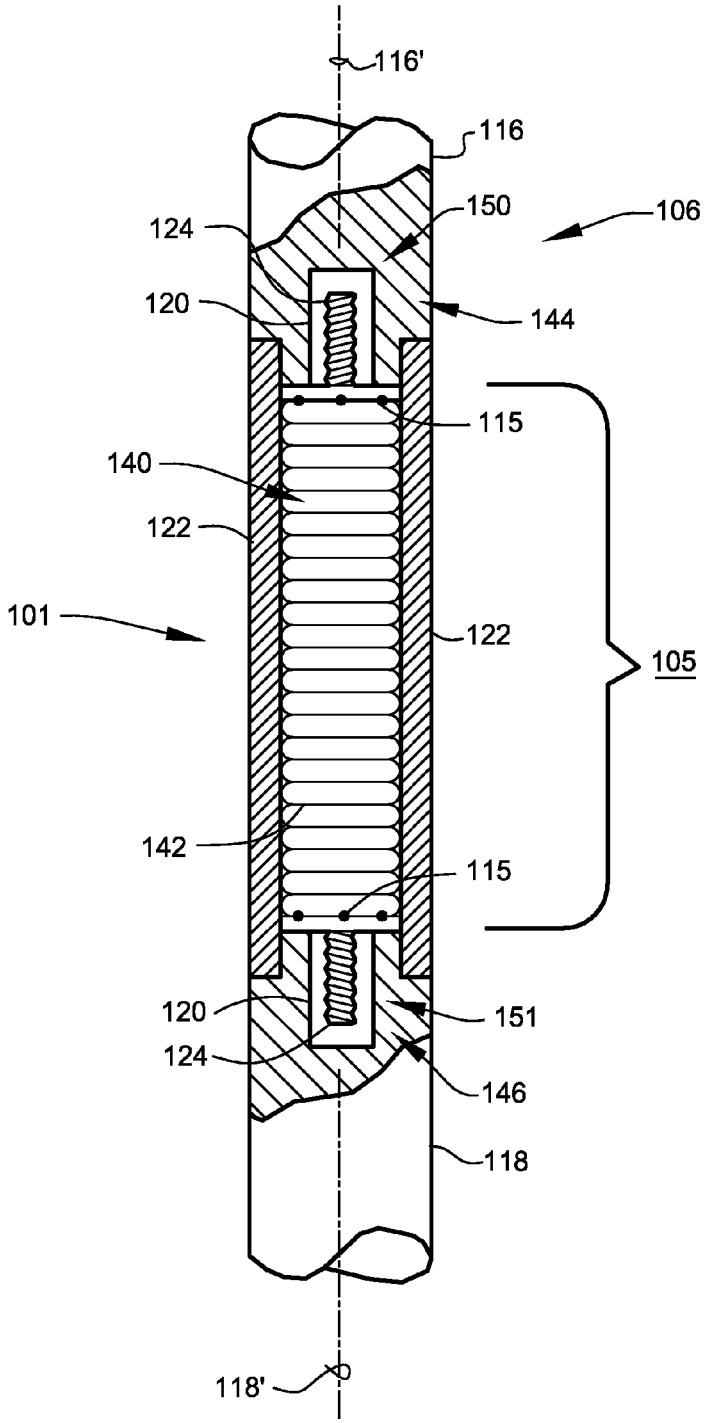
FIG. 2 shows a partial cut-away view, illustrating preferred internal components of an omni-directional flexor of an umbrella shaft of the wind-resistant umbrella of FIG. 1.

FIG. 2 shows a partial cut-away view illustrating the internal components of omni-directional flexor 101 of shaft support 106, according to a preferred embodiment of the present invention. Preferably, shaft support 106 is divided into two portions identified herein as first shaft portion 116, and second shaft portion 118, as shown. Preferably, omni-directional flexor 101 is preferably positioned between first shaft portion 116, and second shaft portion 118, as shown. Preferably, first shaft portion 116 comprises first longitudinal axis 116', as shown. Second shaft portion 118 preferably comprises second longitudinal axis 118', as shown. Preferably, first shaft portion 116 and second shaft portion 118 each comprise a substantially cylindrical rod of substantially uniform diameter.

Preferably, both first shaft portion 116 and second shaft portion 118 are constructed from at least one substantially rigid material. Materials preferred for use in constructing first shaft portion 116 and second shaft portion 118 include hollow metal tubing (see FIG. 8), alternately preferably wood (see FIG. 5), alternately preferably plastic (preferably including composite fiber-reinforced polymers). In a preferred embodiment of flexible-shaft umbrella 102, shaft support 106 comprises a preferred diameter of about 1½ inches with an overall length in the general range of about one-hundred inches.

In FIG. 2, omni-directional flexor 101 is depicted in the normally un-unloaded position (a condition wherein minimal non-axial load forces are being transferred from umbrella canopy 104 to shaft support 106). Preferably, omni-directional flexor 101 comprises at least one resilient member 140 structured and arranged to provide resilient bending in response to the non-axial force loading originating at umbrella canopy 104. Most preferably, resilient member 140 comprises at least one coiled spring 142, as shown.

Preferably, the upper end of coiled spring 142 is coupled to first shaft portion 116 by first shaft coupler 144, as shown. Preferably, first shaft coupler 144 comprises a detachable coupler, most preferably a threaded coupler identified herein as first threaded coupler 150. Preferably, the lower end of coiled spring 142 is coupled to second shaft portion 118 using a similar coupler arrangement, identified herein as second shaft coupler 146. Preferably, second shaft coupler 146 also comprises a detachable coupler, most preferably a threaded coupler identified herein as second threaded coupler 151.

Preferably, both first threaded coupler 150 and second threaded coupler 151 comprise male threaded extensions 124 joined to respective female threaded sleeves 120, as shown. Preferably, a single female threaded sleeve 120 is integrated within the lower end of first shaft portion 116 substantially coaxial with first longitudinal axis 116', as shown. Preferably, a single female threaded sleeve 120 is integrated within the upper end of second shaft portion 118 preferably substantially coaxial with second longitudinal axis 118', as shown. Female threaded sleeves 120 further function as solid and durable mounting points within softer shaft materials (such as wood). Female threaded sleeve 120 is preferably constructed from a substantially rigid material such as plastic, more preferably metal.

Preferably, male threaded extension 124 is rigidly mounted to coiled spring 142. Preferably, each male threaded extension 124 is rigidly mounted to a respective end of coiled spring 142 using thermal welding, most preferably by spot-welding 115. Upon reading the teachings of this specification, those of ordinary skill in the art will now understand that, under appropriate circumstances, considering such issues as cost, intended use, etc., other coupler arrangements, such as friction sockets, bayonet-type couplers, snap-lock couplers, bonding etc., may suffice.

When in a resting position (i.e., an unloaded position), coiled spring 142 preferably functions to maintain first longitudinal axis 116' and second longitudinal axis 118' in the depicted coaxial orientation of FIG. 2. Coiled spring 142 preferably functions as a "biaser" to positionally bias first longitudinal axis 116' and second longitudinal axis 118' toward the depicted coaxial orientation preferred during use.

Figure 3:
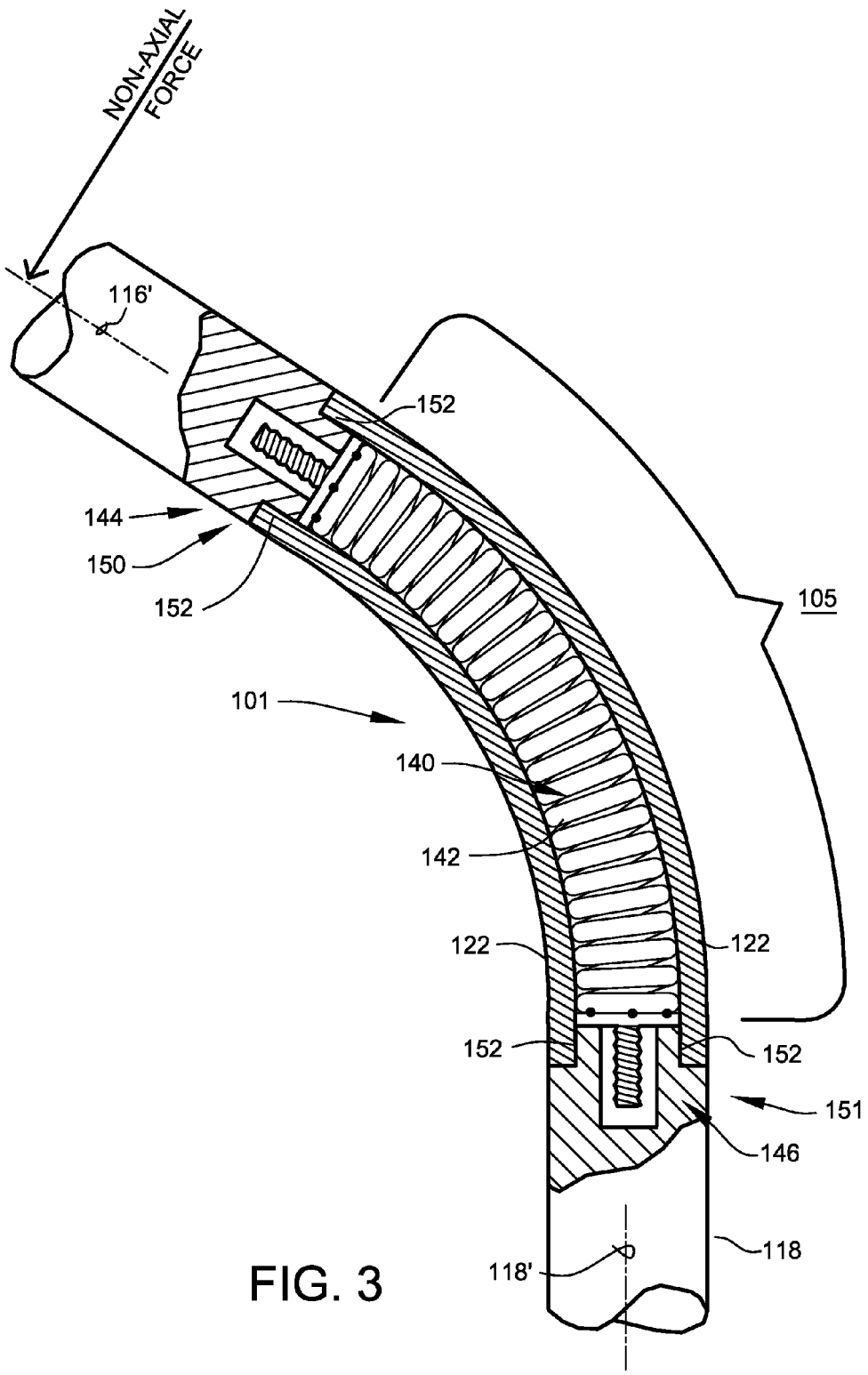
FIG. 3 shows a partial cut-away view, illustrating the omni-directional flexor in a position of deflection, according to the preferred embodiment of FIG. 2.

Preferably, coiled spring 142 is of an extension type, preferably constructed of wires or rods formed to a generally circular section. Coiled spring 142 is preferably adapted to absorb and store energy by offering resistance to bending forces. Preferably, the strength of coiled spring 142 is selected to allow for movement of first longitudinal axis 116' and second longitudinal axis 118' away from a substantially coaxial orientation when a predetermined level of force is applied to first shaft portion 116, more specifically, when a predetermined level of unequal loading occurs between first shaft portion 116, and second shaft portion 118, as shown in FIG. 3. Preferably, such predetermined level of force is less than the maximum structural capacity of either first shaft portion 116 or second shaft portion 118.

FIG. 3 shows a partial cut-away view, illustrating omni-directional flexor 101 in a position of deflection, according to the preferred embodiment of FIG. 2. Preferably, the extension-type spring of coiled spring 142 is wound with a pre-selected initial tension. This internal force is preferably designed to hold the coils tightly together until overcome by external loading above a specific force level. This preferred built-in load, known in the art as initial tension, can be varied within a selectable range. Preferably, a designer of ordinary skill in the art may select an extension spring, comprising appropriate strength and performance, using customary compression rate and stress formulas. Preferably, on removal of the wind loading, the spring restitution force stored in coiled spring 142 returns first longitudinal axis 116' and second longitudinal axis 118' to the depicted coaxial orientation of FIG. 2 (at least embodying herein wherein such at least one coiled spring is capable of storing at least one spring return force of sufficient magnitude to return such at least one first shaft portion and such at least one second shaft portion to such at least one substantially coaxial orientation when such force applied to such at least one first shaft portion is substantially absent). Thus, coiled spring 142 of flexible umbrella 102 preferably enables shaft 106 to move or sway in any direction when flexible umbrella 102 is to be subjected to stressful and or windy conditions.

To protect coiled spring 142 from the elements, and to prevent inadvertent pinching of the hand of a user during deflection, coiled spring 142 is preferably covered by outer sleeve 122, as shown. Preferably, outer sleeve 122 comprises at least one substantially resilient composition adapted to resiliently deform in coordination with resilient bending of coiled spring 142. Preferably, outer sleeve 122 comprises a hollow cylindrical tube constructed from a synthetic material, preferably a firm rubber, most preferably a neoprene rubber. Outer sleeve 122 may comprise an integral color to harmonize with the overall aesthetics of flexible umbrella 102. For, example, outer sleeve 122 may preferably comprise a color substantially matching that of flexible shade material 107. Preferably, outer sleeve 122 is slid over coiled spring 142 prior to assembly of omni-directional flexor 101 to first shaft portion 116 and second shaft portion 118. Preferably, the ends of first shaft portion 116 and second shaft portion 118, proximal to omni-directional flexor 101, comprise recessed circumferential notches 152, as shown. Preferably, such circumferential notches 152 comprise an outer diameter substantially matching the inner diameter of outer sleeve 122, as shown. Preferably, circumferential notches 152 allow the outer surface of outer sleeve 122 to be positioned substantially flush with the exterior diameters of first shaft portion 116 and second shaft portion 118, as shown. Therefore, when assembled in this fashion, the flexible shaft support has the appearance of a smooth continuous piece.

Upon reading this specification, those with ordinary skill in the art will now appreciate that, under appropriate circumstances, considering such issues as user preferences, cost, structural requirements, available materials, available markets, umbrella size, etc., other types of umbrellas, such as, for example, beach umbrellas, patio umbrellas, market umbrellas etc., may suffice.

Figure 4:
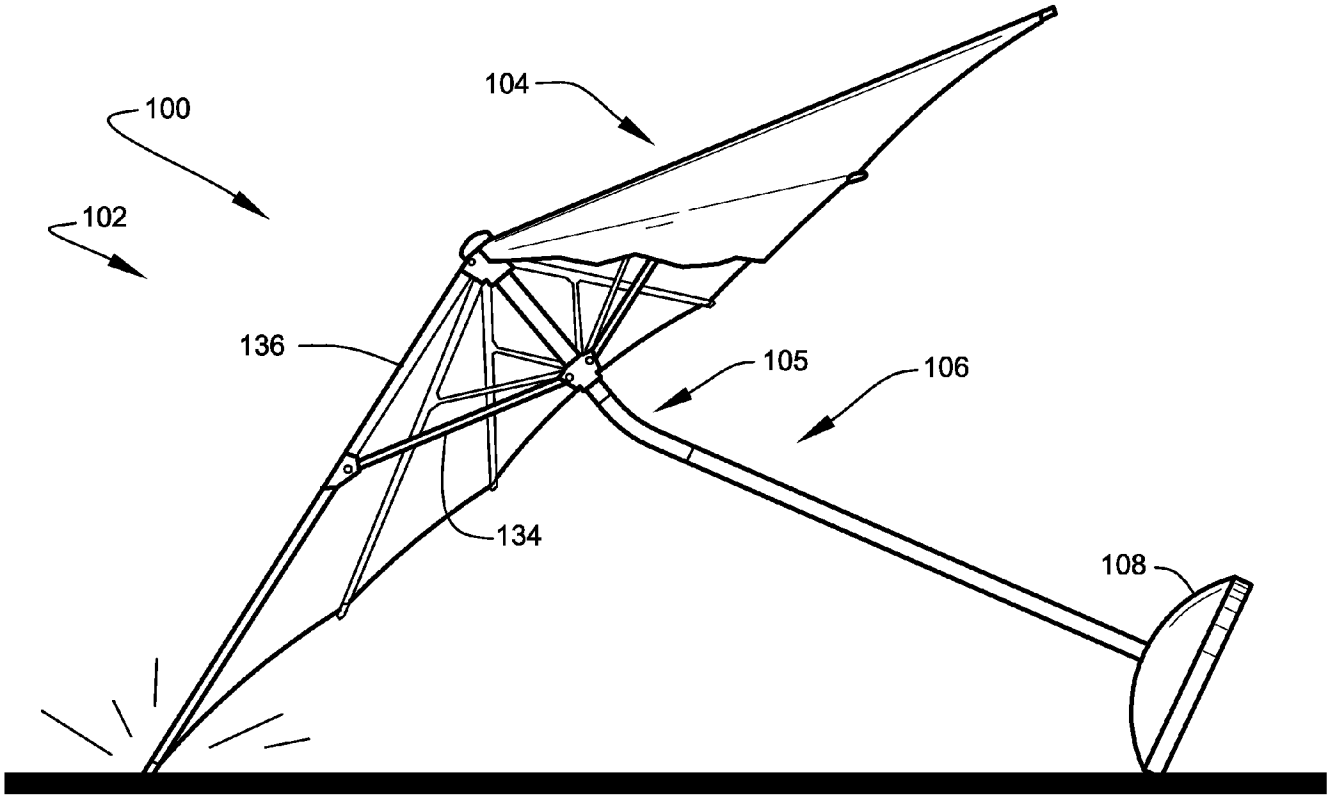
FIG. 4 shows a schematic diagram, illustrating the protection of an umbrella canopy of the flexible-shaft umbrella by the deflection omni-directional flexor after tipping, according to a preferred embodiment of the present invention.

FIG. 4 shows a schematic diagram illustrating the protection of the rigid and relatively lightweight support elements of umbrella canopy 104 by the deflection omni-directional flexor 101 on overturning. In very heavy wind conditions, the system may occasionally experience tipping when the wind force exceeds the resistance to overturning afforded by the weighted umbrella stand 108, outdoor furniture element 111, etc.

The preferred configuration of shaft support 106 assists in protecting both the radially disposed stretchers 134 and radially disposed ribs 136 of umbrella canopy 104 from impact damage by functioning essentially as a shock absorber to protectively absorb a portion the impact forces generated by collision of the support elements with hard surface 160, as shown. A measure of protection is developed regardless of the location omni-directional flexor 101 within shaft support 106 (i.e., a position near the midpoint of shaft support 106, as illustrated in FIG. 1A, or near the upper portion of shaft support 106, is illustrated in FIG. 1C).

Figure 5:
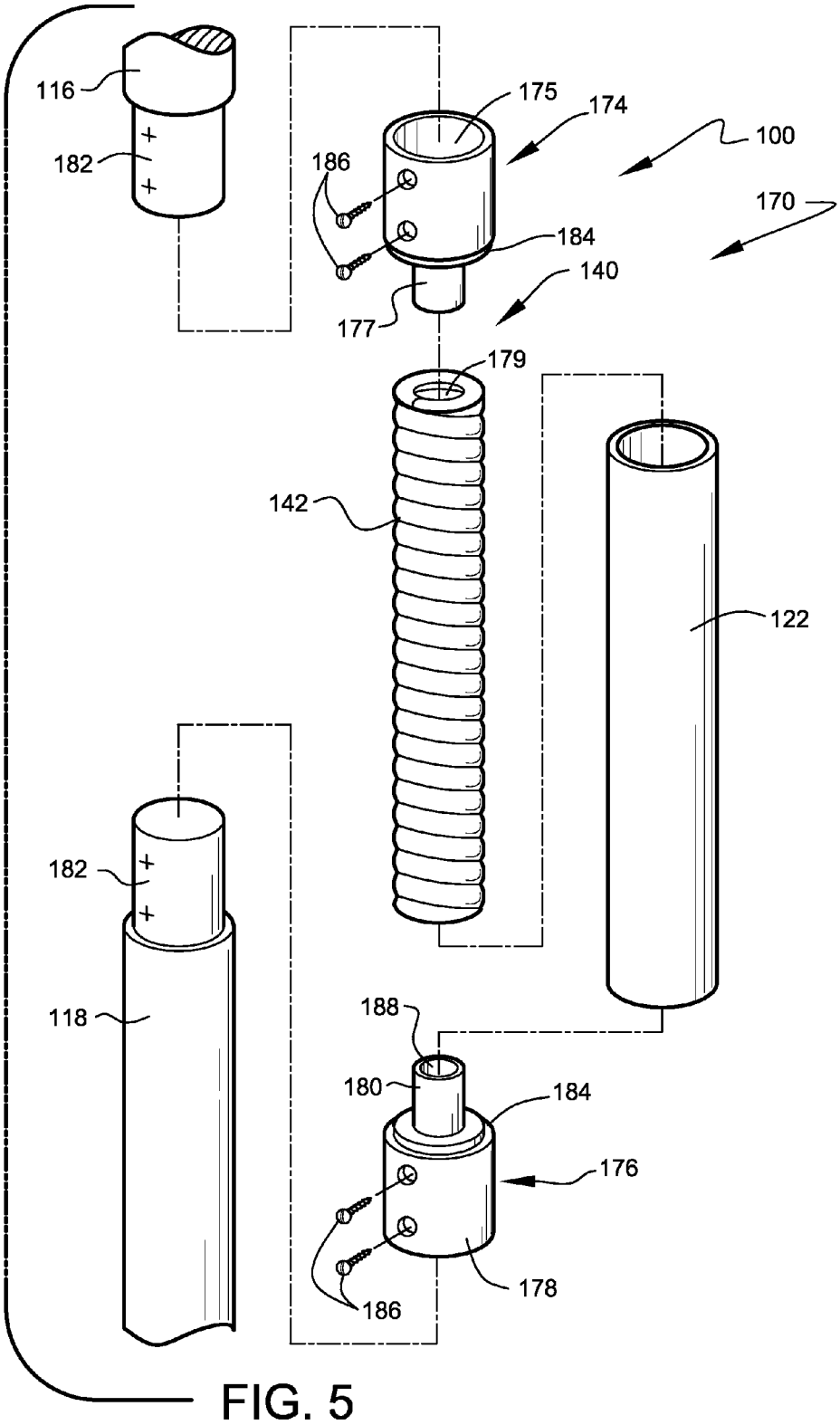
FIG. 5 shows an exploded view, of an alternate omni-directional flexor, according to a preferred embodiment of the present invention.
Figure 7:
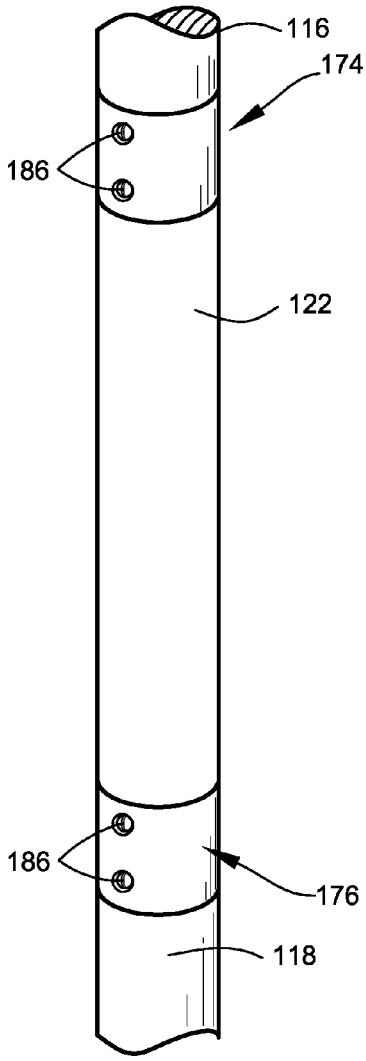
FIG. 7 shows a perspective view, in partial section, illustrating the alternate omni-directional flexor of FIG. 5, in an assembled configuration.

FIG. 5 shows an exploded view of alternate omni-directional flexor 170, according to another preferred embodiment of the present invention. As illustrated in the exploded view of FIG. 5, alternate omni-directional flexor 170 preferably retains a number of the components used in the construction of omni-directional flexor 101, as shown. For example, alternate omni-directional flexor 170 preferably comprises a resilient member 140 to provide resilient bending in response to the non-axial force loading originating at umbrella canopy 104. As in the prior embodiment, resilient member 140 most preferably, comprises coiled spring 142, as shown. In addition, a resilient outer sleeve 122 preferably covers coiled spring 142 during use, as illustrated in FIG. 7. Alternate omni-directional flexor 170 also comprises several distinct structural features differentiating it from omni-directional flexor 101, as noted below.

Figure 6:
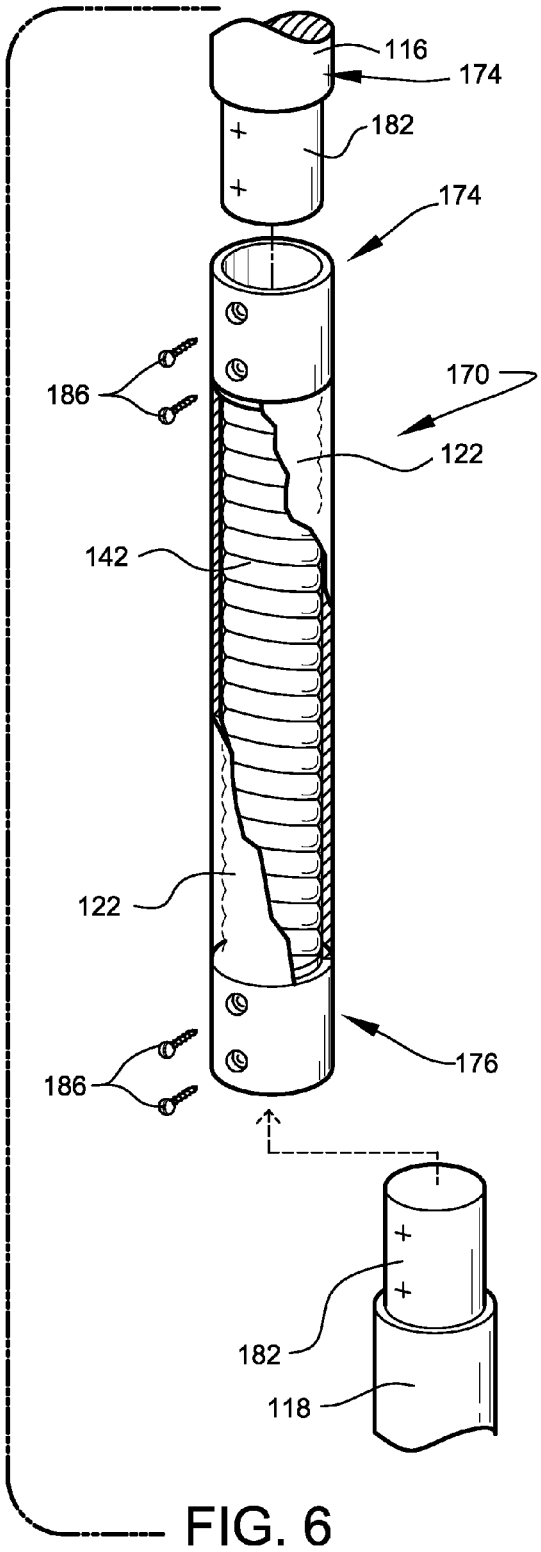
FIG. 6 shows an exploded view, of the alternate omni-directional flexor of FIG. 5, in a partially assembled configuration.

Preferably, the upper end of coiled spring 142 is coupled to first shaft portion 116 by an alternate first shaft coupler 174, as shown. Alternate first shaft coupler 174 preferably comprises socket receiver 175 adapted to receive first shaft portion 116, and a spring-engaging projection 177, as shown. Preferably, socket receiver 175 and spring-engaging projection 177 are generally circular and substantially coaxial, as shown. Projection 177 is preferably adapted to engage the upper interior bore 179 of coiled spring 142, as shown. Spring-engaging projection 177 has been found to beneficially assist in maintaining a stable connection between alternate first shaft coupler 174 and coiled spring 142. Preferably, alternate first shaft coupler 174 is rigidly mounted to the end of coiled spring 142, preferably using thermal welding, most preferably by spot-welding 115, as best shown in FIG. 6.

The lower end of coiled spring 142 is preferably coupled to second shaft portion 118 using alternate second shaft coupler 176, as shown. Preferably, alternate second shaft coupler 176 comprises socket receiver 178 and a spring-engaging projection 180, preferably adapted to engage the lower interior bore of coiled spring 142, as shown. Preferably, socket receiver 178 is adapted to receive second shaft portion 118. Both socket receiver 178 and spring-engaging projection 180 are generally circular and substantially coaxial, as shown.

Preferably, the ends of both first shaft portion 116 and second shaft portion 118 comprise reduced diameter region 182, as shown. Preferably, the radius of each reduced diameter region 182 is matched to the inner radius of each respective alternate first shaft coupler, as shown. The reduction in radius dimension is preferably equal to about the wall thickness of its respective socket receiver (socket receiver 175 and/or socket receiver 178). This preference assures that the outer surface of each shaft portion is justified with the outer surface of its respective socket receiver (see FIG. 7).

In a similar arrangement, the proximal end (relative to coiled spring 142) of each socket receiver (socket receiver 175 and socket receiver 178) preferably comprises a circumferential recess 184 adapted to receive the terminating end of rubber sleeve 122. The above preference also assures that the outer diameter of rubber sleeve 122 is justified with the outer diameters of socket receiver 175 and socket receiver 178 (see FIG. 7). Preferably, both socket receiver 175 and socket receiver 178 are retained on their respective shaft portions by mechanical fasteners, preferably a set of screws 186, as shown.

Alternate first shaft coupler 174 and alternate second shaft coupler 176 are preferably constructed from a substantially rigid material, preferably plastic, more preferably a metal. Preferred embodiments of socket receiver 175 and socket receiver 178 preferably comprise a continuous open internal bore 188 adapted to facilitate passage of control cords and/or cables of the umbrella, as further described in FIG. 8.

FIG. 6 shows an exploded view, of alternate omni-directional flexor 170 of FIG. 5, in a partially assembled configuration. FIG. 7 shows a perspective view, in partial section, illustrating alternate omni-directional flexor 170 of FIG. 5, in an assembled configuration.

Figure 8:
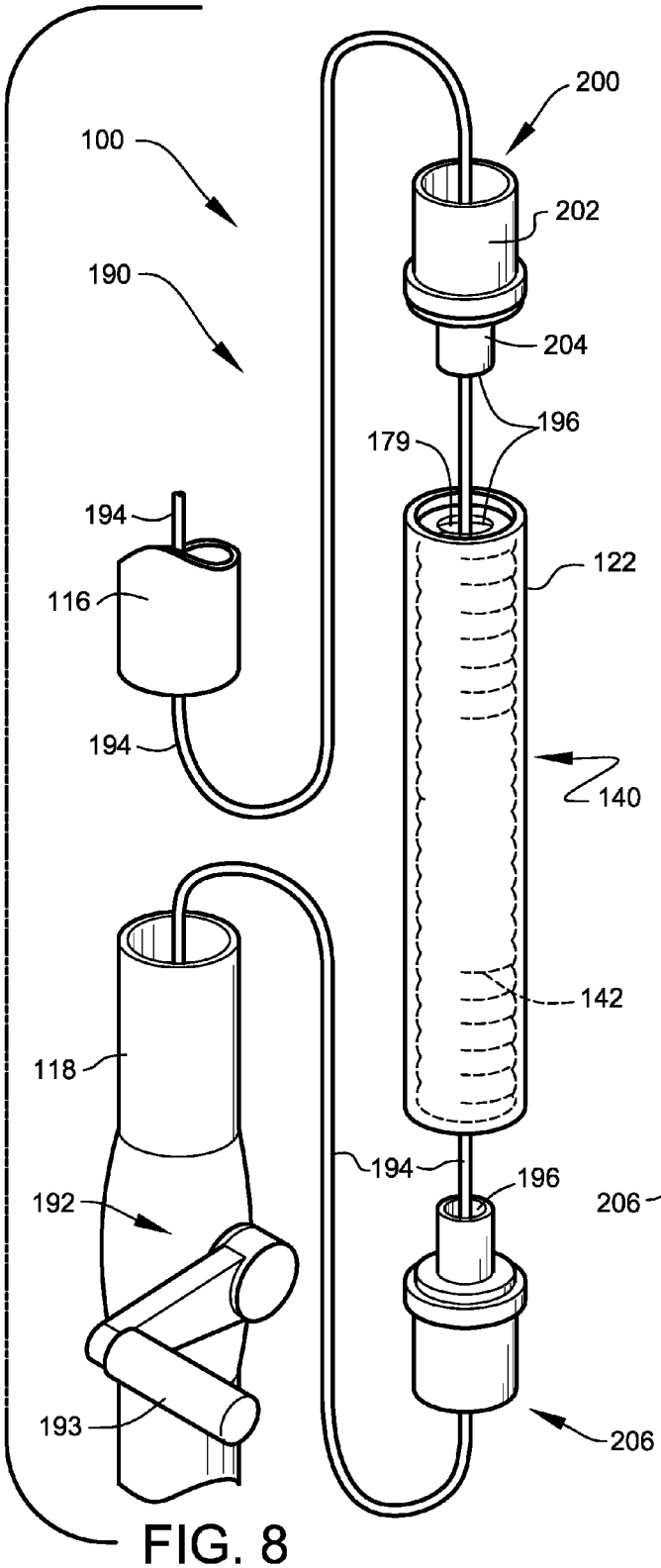
FIG. 8 shows an exploded view, of an alternate omni-directional flexor, according to a preferred embodiment of the present invention.

FIG. 8 shows an exploded view of alternate omni-directional flexor 190, preferably comprising a means for accommodating the operation of remote operator 192, according to another preferred embodiment of the present invention. Patio umbrellas and market umbrellas often comprise a hand-operated remote operator 192 to assist in the convenient lifting and lowering of lower runner 132 (see FIG. 1C), which results in the opening and closing of umbrella canopy 104. An example of a remote operator 192 is a mechanism comprising hand-operated crank 193 operably engaged with lower runner 132 by means of an internal cord 194. In preferred embodiment of FIG. 8, remote operator 192 is shown positioned within second shaft portion 118.

Preferably, both first shaft portion 116 and second shaft portion 118 comprise hollow tubular sections allowing internal cord 194 to pass through their respective interiors, as shown. Preferably, alternate omni-directional flexor 190 comprises a corresponding continuous hollow interior channel 196 to allow internal cord 194 to pass unencumbered between the hollow interiors of first shaft portion 116 and second shaft portion 118, as shown (at least embodying herein wherein said at least one first substantially rigid shaft portion and said at least one second substantially rigid shaft portion each comprise at least one hollow cylindrical tube; and at least embodying herein at least one continuous internal passage structured and arrange to allow unencumbered passage of said at least one cord between such substantially hollow interior portions of said at least one first substantially rigid shaft portion and said at least one second substantially rigid shaft portion).

Figure 9:
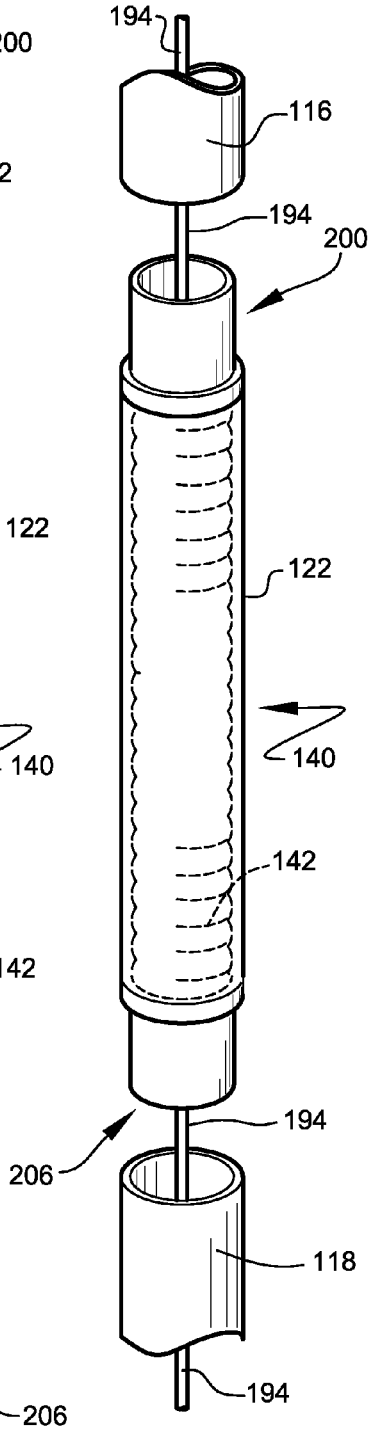
FIG. 9 shows an exploded view, of the alternate omni-directional flexor of FIG. 8, in a partially assembled configuration.
Figure 10:
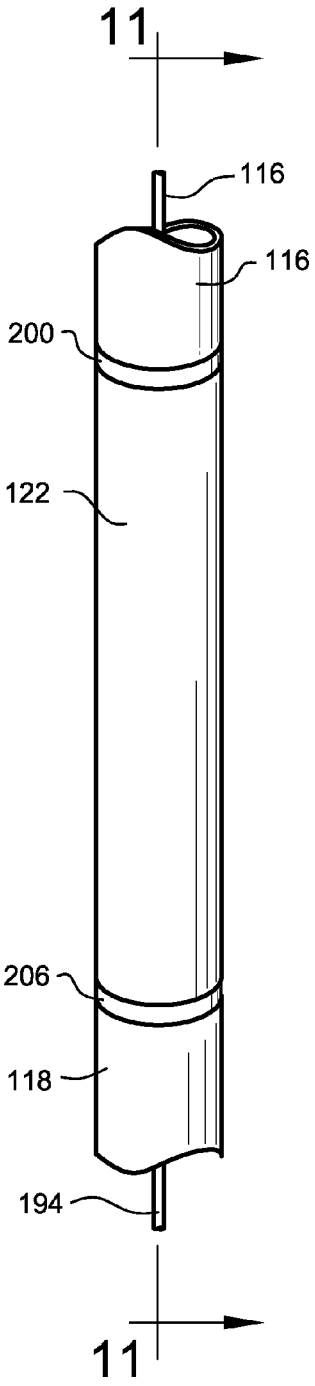
FIG. 10 shows a perspective view, of the alternate omni-directional flexor of FIG. 8, in an assembled configuration.
Figure 11:
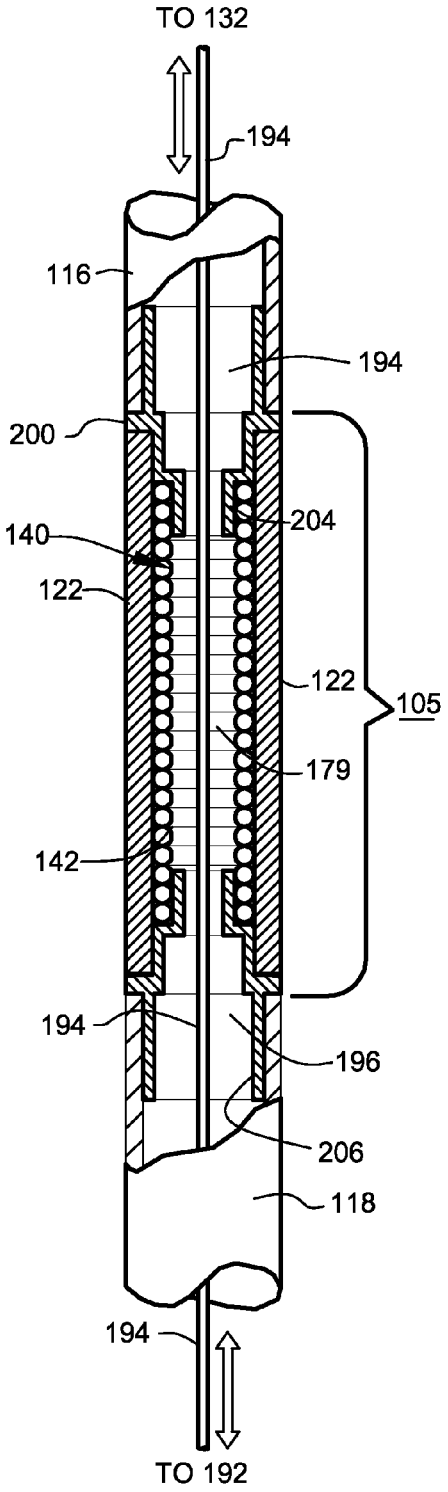
FIG. 11 shows a partial cut-away view, illustrating preferred internal components of the alternate omni-directional flexor of FIG. 8.

FIG. 9 shows an exploded view of alternate omni-directional flexor 190 of FIG. 8 in a partially assembled configuration. FIG. 10 shows a perspective view, of alternate omni-directional flexor 190 of FIG. 8, in an assembled configuration. FIG. 11 shows a partial cut-away view illustrating preferred internal components of alternate omni-directional flexor 190 of FIG. 8.

As illustrated in FIG. 8 through FIG. 11, alternate omni-directional flexor 190 preferably comprises a number of structures and features matching both alternate omni-directional flexor 170 and omni-directional flexor 101, as shown. For example, alternate omni-directional flexor 190 preferably comprises a resilient member 140 to provide resilient bending; and as in the prior embodiments, resilient member 140 most preferably comprises coiled spring 142, as shown. In addition, a resilient outer sleeve 122 preferably covers coiled spring 142 during use, as shown. Alternate omni-directional flexor 190 also comprises several distinct design features enabling the operation of remote operator 192, as noted below.

Preferably, the upper end of coiled spring 142 is coupled to first shaft portion 116 by an alternate first shaft coupler 200, as shown. Alternate first shaft coupler 200 preferably comprises an upper shaft engager 202 adapted to engage the hollow interior of first shaft portion 116, and a lower spring-engaging projection 204, as shown. Preferably, shaft engager 202 and spring-engaging projection 204 are generally circular and substantially coaxial, as shown. Spring-engaging projection 204 is preferably adapted to engage the interior bore 179 of coiled spring 142, as shown. As noted in the prior embodiments, the spring-engaging projections have been found to assist in maintaining a rigid connection between the shaft couplers and coiled spring 142. Preferably, alternate first shaft coupler 200 is rigidly mounted to the end of coiled spring 142, preferably using thermal welding, most preferably by spot-welding.

The lower end of coiled spring 142 is preferably coupled to second shaft portion 118 using alternate second shaft coupler 206, as shown. Preferably, alternate second shaft coupler 206 comprises substantially the same physical arrangements as those of alternate first shaft coupler 200.

Preferably, shaft engager 202 comprises a reduced diameter region 208, as shown. Preferably, the radius of reduced diameter region 208 is matched to the inner radius of first shaft portion 116, as shown. The reduction in radius dimension is preferably equal to about the wall thickness of first shaft portion 116. Preferably, alternate second shaft coupler 206 comprises substantially the same physical arrangements as those of alternate first shaft coupler 200. This preference enables the outer surfaces of each shaft portion to be justified with the outer surfaces of their respective shaft couplers (see FIG. 10).

In a similar arrangement, alternate first shaft coupler 200 is preferably adapted to receive a terminating end of rubber sleeve 122 such that the outer diameter of rubber sleeve 122 is justified with the outer diameter first shaft portion 116 (see FIG. 10). It is again noted that alternate second shaft coupler 206 preferably comprises substantially the same physical arrangements as those of alternate first shaft coupler 200.

When assembled, alternate omni-directional flexor 190 preferably allows internal cord 194 to freely move within hollow interior channel 196, as diagrammatically indicated by the reference arrows, as shown. Preferably, both alternate first shaft coupler 200 and alternate second shaft coupler 206 are preferably constructed from a substantially rigid material, preferably plastic, more preferably a metal comprising material. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, carbon fiber, metallic composites, inventive plasticizers, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. An umbrella system related to reducing wind damage in outdoor umbrellas subjected to at least one wind load during use, said system comprising:
   a) at least one umbrella structured and arranged to provide a shade protection;
   b) wherein said at least one umbrella comprises
      i) at least one umbrella shade structured and arranged to provide said shade protection,
      ii) at least one shaft support being coupled with said at least one umbrella shade wherein said at least one shaft support is structured and arranged to support said at least one umbrella shade in at least one operable position, and
      iii) at least one umbrella stand being coupled with said at least one shaft support wherein said at least one umbrella stand is structured and arranged to support said at least one shaft support in at least one operable position;
   c) wherein said at least one shaft support comprises at least one omni-directional flexor structured and arranged to provide omni-directional flexing of said at least one shaft support when said at least one umbrella shade is subjected to the at least one wind load; and
   d) wherein such omni-directional flexing assists in reducing deflection-related failure within said at least one shaft support when said at least one shaft support is subjected to force loading.

2. The umbrella system according to claim 1 wherein said at least one shaft support further comprises:
   a) at least one first substantially rigid shaft portion comprising at least one first longitudinal axis;
   b) at least one second substantially rigid shaft portion comprising at least one second longitudinal axis; and
   c) at least one shaft-end coupler structured and arranged to structurally couple said at least one first substantially rigid shaft portion to said at least one umbrella shade;
   d) wherein said at least one shaft-end coupler is structured and arranged to transmit at least one non-axial force between said at least one first substantially rigid shaft portion and said at least one umbrella shade; and
   e) wherein said at least one omni-directional flexor comprises
      i) at least one resilient member structured and arranged to provide resilient bending in response to non-axial force loading,
      ii) at least one first shaft coupler structured and arranged to couple said at least one resilient member to said at least one first substantially rigid shaft portion, and
      iii) at least one second shaft coupler structured and arranged to couple said at least one resilient member to said at least one second substantially rigid shaft portion.

3. The umbrella system according to claim 2 wherein said at least one omni-directional flexor further comprises at least one biaser structured and arranged to bias said at least one first longitudinal axis and said at least one second longitudinal axis to at least one substantially coaxial orientation.

4. The umbrella system according to claim 3 wherein said at least one biaser provides a movement of said at least one first longitudinal axis and said at least one second longitudinal axis away from such at least one substantially coaxial orientation when a predetermined level of force is applied to said at least one first substantially rigid shaft portion.

5. The umbrella system according to claim 4 wherein said at least one biaser comprises at least one coiled spring.

6. The umbrella system according to claim 5 wherein said at least one coiled spring is capable of storing at least one spring return force of sufficient magnitude to return said at least one first shaft portion and said at least one second shaft portion to such at least one substantially coaxial orientation when such force applied to said at least one first shaft portion is substantially absent.

7. The umbrella system according to claim 6 wherein such resilient bending occurs substantially within said at least one coiled spring.

8. The umbrella system according to claim 7 further comprising:
   a) at least one outer cover structured and arranged to cover said at least one coiled spring;

b) wherein said at least one outer cover comprises at least one substantially resilient composition structured and arranged to resiliently deform in coordination with the resilient bending of said at least one resilient member.

9. The umbrella system according to claim 5 wherein said at least one first substantially rigid shaft portion and said at least one second substantially rigid shaft portion each comprise a substantially cylindrical rod.

10. The umbrella system according to claim 5 wherein said at least one omni-directional flexor is located closer to said at least one umbrella shade than to said at least one umbrella stand.

11. The umbrella system according to claim 5 wherein:

a) said at least one first substantially rigid shaft portion and said at least one second substantially rigid shaft portion each comprise at least one hollow cylindrical tube having a substantially hollow interior portion; and b) said at least one second substantially rigid shaft portion comprises at least one remote operator structured and arranged to remotely operate opening and closing of said at least one umbrella shade;

c) wherein said at least one remote operator comprises at least one cord structured and arranged to operably connect said at least one remote operator with said at least one umbrella shade;

d) wherein said at least one cord passes through such substantially hollow interior portions of said at least one first substantially rigid shaft portion and said at least one second substantially rigid shaft portion; and e) wherein said at least one omni-directional flexor comprises at least one continuous internal passage structured and arrange to allow unencumbered passage of said at least one cord between such substantially hollow interior portions of said at least one first substantially rigid shaft portion and said at least one second substantially rigid shaft portion.

12. The umbrella system according to claim 5 wherein:

a) said at least one first shaft coupler comprises at least one first threaded coupler structured and arranged to threadably couple said at least one first shaft coupler to said at least one first substantially rigid shaft portion; and b) said at least one second shaft coupler comprises at least one second threaded coupler structured and arranged to threadably couple said at least one second shaft coupler to said at least one second substantially rigid shaft portion.

13. The umbrella system according to claim 5 wherein:

a) said at least one coiled spring comprises at least one interior bore; and b) said at least one first shaft coupler and said at least one second shaft coupler each comprise at least one projecting engager structured and arranged to engage at least one interior bore of said at least one coiled spring.

14. An umbrella system related to reducing wind damage in outdoor umbrellas subjected to at least one wind load during use, said system comprising:

a) at least one umbrella structured and arranged to provide a shade protection;

b) wherein such at least one umbrella comprises i) at least one umbrella shade structured and arranged to provide said shade protection, and ii) at least one shaft support being coupled with said at least one umbrella shade wherein said at least one shaft support is structured and arranged to support said at least one umbrella shade in at least one operable position;

c) wherein said at least one shaft support comprises i) at least one first shaft portion comprising at least one first longitudinal axis, and ii) at least one second shaft portion comprising at least one second longitudinal axis, d) positioned between said at least one first shaft and said at least one second shaft, at least one coil spring, and e) at least one furniture element being coupled with said at least one shaft support wherein said at least one furniture element is structured and arranged to support said at least one shaft support in at least one operable position;

f) wherein said at least one coil spring is structured and arranged to i) bend in response to the application of at least one predetermined amount of force to said at least one shaft support, and ii) maintain said first longitudinal axis and said at least one second longitudinal axis in at least one substantially coaxial orientation when such force is less than such predetermined amount; and g) wherein such bending assists in reducing structural failure within said at least one shaft support when at least one force greater than such at least one predetermined amount of force is applied to said at least one shaft support.

15. The umbrella system according to claim 14 wherein such bending occurs substantially at said at least one coil spring.

16. The umbrella system according to claim 15 wherein said at least one coiled spring is capable of storing at least one spring return force of sufficient magnitude to return said at least one first shaft portion and said at least one second shaft portion to such at least one substantially coaxial orientation when such force applied to said at least one first shaft portion is substantially absent.

17. The umbrella system according to claim 14 further comprising:

a) at least one outer cover structured and arranged to cover said at least one coiled spring;

b) wherein said at least one outer cover comprises at least one substantially resilient composition structured and arranged to resiliently deform in coordination with such bending.

18. The umbrella system according to claim 17 wherein said at least one first shaft portion and said at least one second shaft portion each comprises a substantially cylindrical rod.

19. The umbrella system according to claim 17 wherein said at least one first shaft portion, said at least one second shaft portion, and said at least one outer cover each comprise a substantially similar outer diameter.

20. An umbrella system related to reducing wind damage in outdoor umbrellas subjected to at least one wind load during use, said system comprising:

a) umbrella means for providing a shade protection;

b) wherein said umbrella means comprises i) umbrella shade means for providing said shade protection, ii) shaft support means for supporting said umbrella shade means in at least one operable position wherein said shaft support means are coupled with said umbrella shade means, and iii) umbrella stand means for supporting said shaft support means in at least one operable position wherein said umbrella stand means are coupled with said shaft support means;

c) wherein said shaft support means comprises omni-directional flexor means for providing omni-directional flexing of such shaft support means when said umbrella shade means is subjected to the at least one wind load;

d) wherein such omni-directional flexing assists in reducing deflection-related failure within said shaft support means when said shaft support means is subjected to force loading;

e) wherein said omni-directional flexor means comprises spring-force means for providing at least one spring force;

f) wherein said spring-force means is structured and arranged to store at least one restorative force of sufficient magnitude to return said shaft support means to such at least one substantially un-flexed configuration when such force loading is substantially absent.

* * * * *